US011326562B2

(12) United States Patent
Yoshida

(10) Patent No.: US 11,326,562 B2
(45) Date of Patent: May 10, 2022

(54) FUEL ADSORPTION APPARATUS AND EVAPORATED FUEL PROCESSING APPARATUS USING FUEL ADSORPTION APPARATUS

(71) Applicants: Mahle International GmbH, Stuttgart (DE); Mahle Filter Systems Japan Corporation, Tokyo (JP)

(72) Inventor: Hiroyuki Yoshida, Tokyo (JP)

(73) Assignees: Mahle Filter Systems Japan Corporation; Mahle International GmbH

( * ) Notice: Subject to any disclaimer, the term of this patent is extended or adjusted under 35 U.S.C. 154(b) by 0 days.

(21) Appl. No.: 17/031,839

(22) Filed: Sep. 24, 2020

(65) Prior Publication Data

US 2021/0088006 A1 Mar. 25, 2021

(30) Foreign Application Priority Data

Sep. 25, 2019 (JP) ..... JP2019-173860

(51) Int. Cl.
*F02M 25/08* (2006.01)

(52) U.S. Cl.
CPC ..... *F02M 25/089* (2013.01); *F02M 25/0854* (2013.01)

(58) Field of Classification Search
CPC ..... F02M 25/089; F02M 25/0854
See application file for complete search history.

(56) References Cited

U.S. PATENT DOCUMENTS 3,817,714 A * 6/1974 Wiley ..... F01N 3/30 422/173
6,814,771 B2 * 11/2004 Scardino ..... B01D 53/0415 123/198 E
6,896,852 B1 * 5/2005 Meiller ..... B01D 53/0415 123/519
7,059,306 B2 * 6/2006 Reddy ..... F02M 25/0836 123/518
7,118,716 B2 * 10/2006 Meiller ..... B01D 53/0415 422/180

(Continued)

FOREIGN PATENT DOCUMENTS

JP 2008-106610 A 5/2008
JP 2011-220345 A 11/2011

OTHER PUBLICATIONS

English abstract for JP-2008-106610.
English abstract for JP-2011-220345.

*Primary Examiner* — Xiao En Mo
(74) *Attorney, Agent, or Firm* — Fishman Stewart PLLC

(57) ABSTRACT

A fuel adsorption apparatus may include a tubular housing accommodating a pillar adsorbent configured to adsorb and desorb evaporated fuel. The housing may include a tubular accommodating portion accommodating the pillar adsorbent and disposed spaced apart from an outer peripheral surface of the pillar adsorbent. The housing may also include a support portion extending from an end of the accommodating portion such that the support portion is inclined toward an axis of the housing. The support portion may be structured and arranged to support the pillar adsorbent at an edge disposed between an axial end face of the pillar adsorbent and the outer peripheral surface.

20 Claims, 4 Drawing Sheets

(56) References Cited

U.S. PATENT DOCUMENTS

| | | | | |
|---|---|---|---|---|
| 7,370,641 | B2 * | 5/2008 | Zuchara | F02M 25/0854 123/518 |
| 7,909,919 | B2 * | 3/2011 | Kosugi | F02M 25/0854 96/126 |
| 8,881,710 | B2 * | 11/2014 | Lin | F02M 25/0854 123/519 |
| 10,022,664 | B2 * | 7/2018 | Park | B60K 15/03504 |
| 10,138,848 | B2 * | 11/2018 | Kuboyama | B60K 15/03504 |
| 2005/0081717 | A1 * | 4/2005 | Meiller | F02M 25/0854 96/154 |
| 2009/0223370 | A1 * | 9/2009 | Kosugi | F02M 25/0854 96/126 |
| 2017/0009707 | A1 * | 1/2017 | Kuboyama | F02M 25/0854 |

* cited by examiner

FUEL ADSORPTION APPARATUS AND EVAPORATED FUEL PROCESSING APPARATUS USING FUEL ADSORPTION APPARATUS

CROSS REFERENCE TO RELATED APPLICATIONS

This application claims priority to Japanese Patent Application No. JP 2019-173860, filed on Sep. 25, 2019, the contents of which is hereby incorporated by reference in its entirety.

TECHNICAL FIELD

The present invention relates to a fuel adsorption apparatus (additional canister) that accommodates a pillar adsorbent such as a honeycomb adsorbent and is additionally used for a canister body and an evaporated fuel processing apparatus using the fuel adsorption apparatus.

BACKGROUND

In automobiles using gasoline as fuel, canisters are known as evaporated fuel processing apparatuses for inhibiting evaporated fuel in a fuel tank from being released to the atmosphere. The canisters are designed to temporarily adsorb evaporated fuel generated from the fuel tank and then introduce the atmosphere using an engine negative pressure, desorb the adsorbed evaporated fuel, and suction the evaporated fuel into the engine so that the fuel is burned in the engine.

In recent years, there are canisters provided with a honeycomb adsorbent in response to tightening environmental regulations. The honeycomb adsorbent is additionally used for a canister body to further adsorb a gas that has passed through the canister body. The honeycomb adsorbent is formed into a columnar shape and accommodated in a housing. A configuration in which the honeycomb adsorbent is elastically held in the housing by a holding member is known. The holding member includes an outer peripheral surface holding portion in contact with an outer peripheral surface of the honeycomb adsorbent and an end face holding portion in contact with an end face of the honeycomb adsorbent. The honeycomb adsorbent is attached to the housing via a pair of holding members at both ends (e.g., see Patent Literature 1).

A configuration in which a screen member made of non-woven fabric cloth is wound around an outer peripheral surface is also known. The screen member is in close contact with the inner peripheral surface of the housing. Movement of the honeycomb adsorbent in a radius direction in the housing is restricted by the screen member. The honeycomb adsorbent includes a sealing member that seals a space between the outer peripheral surface of the honeycomb adsorbent and the inner peripheral surface of the housing at one end portion to position and fix the honeycomb adsorbent (e.g., see Patent Literature 2).

CITATION LIST

Patent Literature

Patent Literature 1: Japanese Patent Laid-Open No. 2011-220345

Patent Literature 2: Japanese Patent Laid-Open No. 2008-106610

SUMMARY

In the conventional fuel adsorption apparatus (additional canister) that accommodates a pillar adsorbent such as a honeycomb, when the pillar adsorbent is attached to the housing, the pillar adsorbent is fixed to the housing by providing a separate member at both ends or the outer peripheral surface in addition to the ends. Thus, in the case of the conventional fuel adsorption apparatus, a member for fixing the pillar adsorbent to the housing is needed, causing the number of parts in the fuel adsorption apparatus to increase. Moreover, it is necessary to secure a space for accommodating a member to fix the pillar adsorbent to the housing, which has hindered downsizing of the fuel adsorption apparatus (additional canister for accommodating the pillar adsorbent).

Thus, the present invention has been implemented in view of the above problems and it is an object of the present invention to provide a technique that enables a pillar adsorbent to be easily mounted in a housing in a fuel adsorption apparatus (additional canister) in which the pillar adsorbent such as a honeycomb is accommodated and enables downsizing of the fuel adsorption apparatus.

In order to solve the above problems, a fuel adsorption apparatus according to the present invention includes a pillar adsorbent that is capable of adsorbing and desorbing evaporated fuel and a tubular housing accommodating the pillar adsorbent, characterized in that the housing includes a tubular accommodating portion accommodating the pillar adsorbent in a state of being separated from an outer peripheral surface of the pillar adsorbent and a support portion extending from one end of the accommodating portion so as to be inclined toward an axis of the housing and configured to support the pillar adsorbent at an edge between one end face of the pillar adsorbent in the axial direction and the outer peripheral surface. According to this aspect, the pillar adsorbent that can adsorb and desorb the evaporated fuel is supported by the support portion of the housing at one end in the axial direction. For this reason, no separate holding member is required on one end side supported by the housing and no space in which the holding member is accommodated is required in the housing either, and so it is possible to reduce the number of parts, thereby reducing manufacturing cost of the fuel adsorption apparatus and downsizing the housing.

An elastic member interposed between the support portion of the housing and the edge of the pillar adsorbent may be further provided. According to this aspect, since the pillar adsorbent is not in direct contact with the housing, it is possible to prevent damage to the pillar adsorbent.

The accommodating portion may have a cylindrical shape, the support portion may have a truncated cone shape, and the support portion may be formed concentrically with respect to the accommodating portion. According to this aspect, the end of the pillar adsorbent is adjusted and is always uniformly in contact with the housing at the periphery. This makes a contact pressure between the housing and the pillar adsorbent uniform, making it possible to prevent damage to both.

A sealing member for closing a gap between the outer peripheral surface of the pillar adsorbent and the inner peripheral surface of the accommodating portion of the housing on another end side of the accommodating portion may further be provided. According to this aspect, since another end of the pillar adsorbent not in contact with the housing is held by the sealing member, it is possible to prevent the evaporated fuel from flowing out to the atmosphere side, and buffer impacts in the diameter direction and axial direction transmitted to the pillar adsorbent using the sealing member, thus making it possible to prevent damage to the pillar adsorbent.

The sealing member may include a filter support portion facing another end face of the pillar adsorbent and further include a filter member interposed between the other end face of the pillar adsorbent and the filter support portion of the sealing member. According to this aspect, it is possible to further absorb impact in the axial direction transmitting to the pillar adsorbent.

Furthermore, in order to solve the above problems, an evaporated fuel processing apparatus according to the present invention includes a first fuel adsorption unit for adsorbing and desorbing evaporated fuel from a fuel tank of a vehicle and a second fuel adsorption unit connected to the first fuel adsorption unit and configured to adsorb and desorb the evaporated fuel from the first fuel adsorption unit, characterized in that the second fuel adsorption unit includes the above fuel adsorption apparatus. According to this aspect, it is possible to reduce the number of parts, thereby reducing both manufacturing cost and size of the evaporated fuel processing apparatus.

In a fuel adsorption apparatus (additional canister) that accommodates a pillar adsorbent such as honeycomb, the present invention makes it possible to easily mount the pillar adsorbent in a housing and downsize the fuel adsorption apparatus.

DETAILED DESCRIPTION

Preferred embodiments of the present invention will be described with reference to the accompanying drawings.

The fuel adsorption apparatus according to the present invention accommodates a pillar adsorbent such as a honeycomb adsorbent and is additionally used for a canister body (additional canister) and applied to an evaporated fuel processing apparatus. The evaporated fuel processing apparatus to which the fuel adsorption apparatus according to the present invention is applied is not limited to a specific evaporated fuel processing apparatus. For example, a fuel adsorption apparatus 1 according to an embodiment of the present invention is applied to an evaporated fuel processing apparatus 100 shown in FIG. 1.

Figure 1:
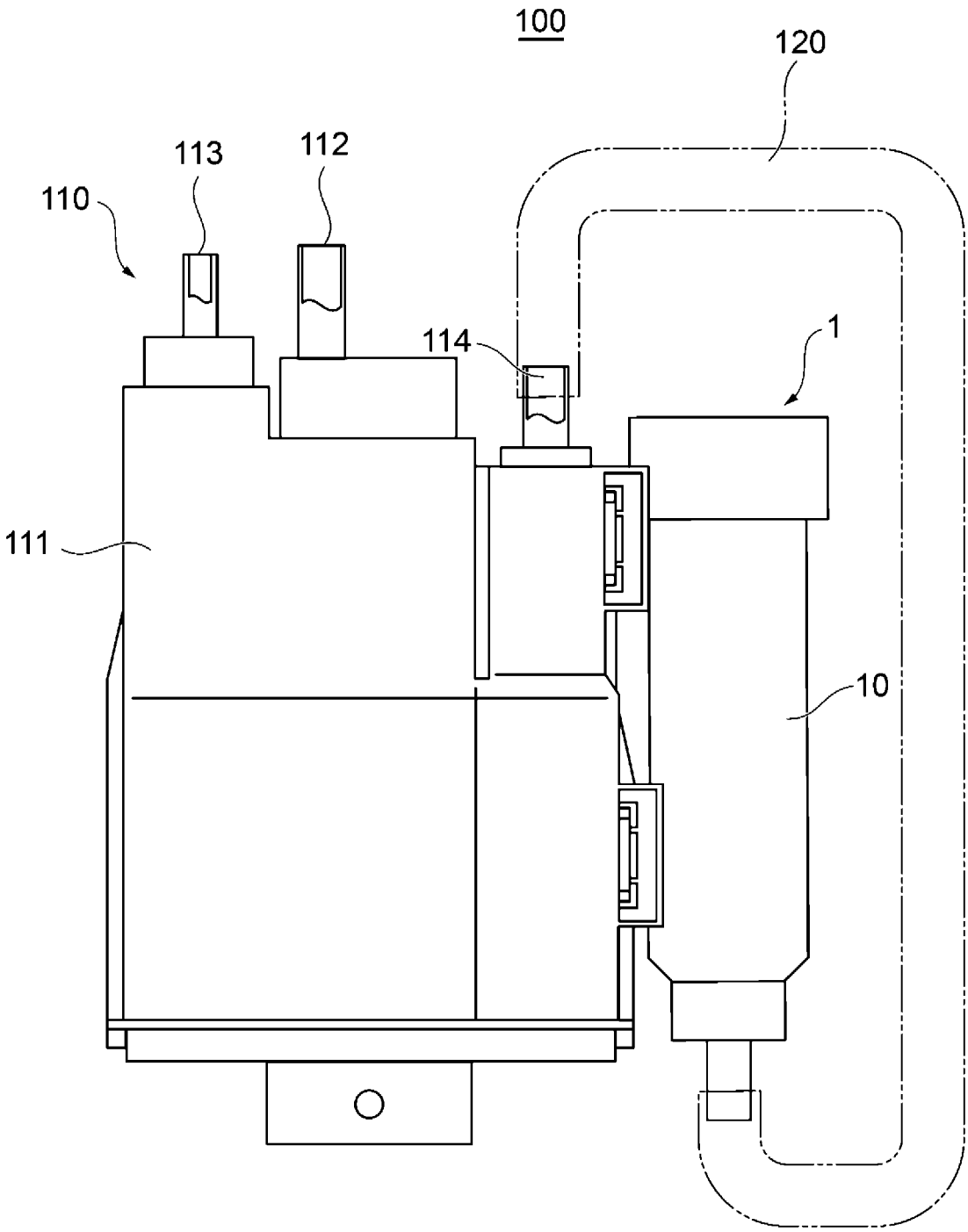
FIG. 1 is a schematic view of an evaporated fuel processing apparatus provided with a fuel adsorption apparatus according to the present invention.

FIG. 1 is a schematic view of the evaporated fuel processing apparatus 100 provided with the fuel adsorption apparatus 1 that accommodates a pillar adsorbent according to the present invention. The evaporated fuel processing apparatus 100 adsorbs fuel evaporated from a fuel tank of a vehicle and the fuel is burned when driving an engine. For vehicles using gasoline as fuel, the evaporated fuel processing apparatus 100 inhibits the evaporated fuel in the fuel tank from being released to the atmosphere. The evaporated fuel processing apparatus 100 adsorbs the evaporated fuel generated from an inside of the fuel tank when the vehicle is stopped. An inside of the evaporated fuel processing apparatus 100 is purged by intake carried out when the engine is driven and the evaporated fuel adsorbed by the evaporated fuel processing apparatus 100 is desorbed from the evaporated fuel processing apparatus 100 and burned in the engine.

The evaporated fuel processing apparatus 100 is provided with a first fuel adsorption unit (canister body) 110 and the fuel adsorption apparatus 1 that accommodates the pillar adsorbent according to the present invention. The first fuel adsorption unit 110 and the fuel adsorption apparatus 1 are connected via a hose 120. In the present embodiment, the fuel adsorption apparatus 1 functions as a second fuel adsorption unit of the evaporated fuel processing apparatus 100, and the housing 111 of the first fuel adsorption unit 110 and a housing 10 of the fuel adsorption apparatus 1 are formed to be separate.

One flow path (not shown) is formed in the first fuel adsorption unit 110. A plurality of activated carbon layers (not shown) to adsorb and desorb the evaporated fuel are disposed in this flow path. The activated carbon layers are made of activated carbon or the like.

The first fuel adsorption unit 110 includes a charge port 112 connected to a fuel tank (not shown) and a purge port 113 connected to an intake system of the engine at positions of the housing 111, which are one end side of the above flow path. The first fuel adsorption unit 110 includes an intermediate port 114 connected to the fuel adsorption apparatus 1, which is a second fuel adsorption unit via the hose 120 at a position of the housing 111 which is another end side of the above flow path. The flow path is folded back in the housing 111. The charge port 112, the purge port 113 and the intermediate port 114 of the first fuel adsorption unit 110 are provided on one end side of the housing 111 (upper side in FIG. 1).

Figure 2:
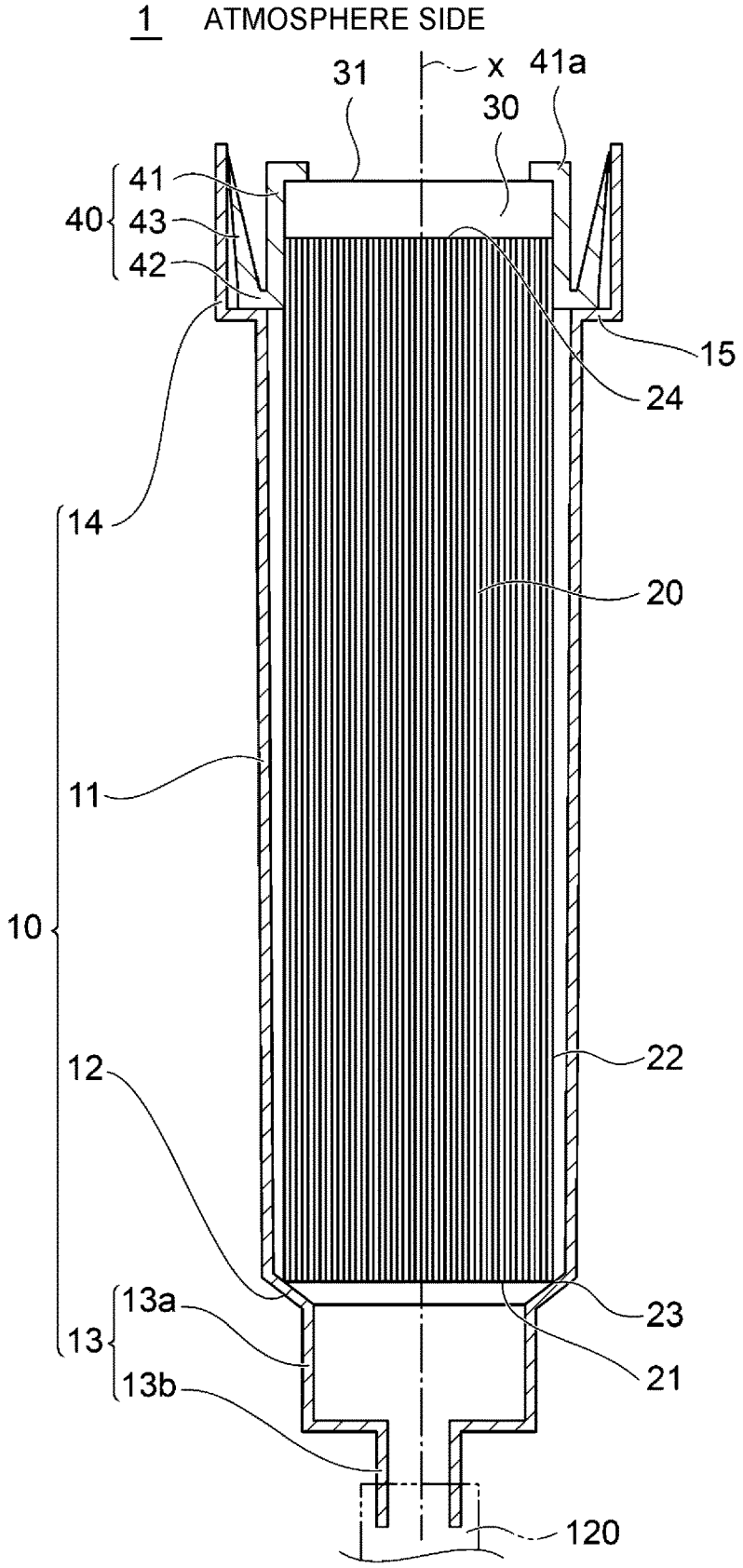
FIG. 2 is a longitudinal cross-sectional view illustrating an embodiment of the fuel adsorption apparatus according to the present invention.

The fuel adsorption apparatus 1 is externally attached to the housing 111 of the first fuel adsorption unit 110 having the above configuration. FIG. 2 is a view illustrating an embodiment of the fuel adsorption apparatus 1 according to the present invention and is a longitudinal cross-sectional view along an axis of the fuel adsorption apparatus 1.

As shown in FIG. 2, the fuel adsorption apparatus 1 according to the embodiment is provided with the housing 10, a honeycomb adsorbent 20, a filter member 30 and a sealing member 40. The housing 10 is formed into a tubular shape and accommodates the honeycomb adsorbent 20. The honeycomb adsorbent 20 is formed into a columnar shape and can adsorb and desorb evaporated fuel. The housing 10 includes a tubular accommodating portion 11 and a support portion 12. The accommodating portion 11 accommodates the honeycomb adsorbent 20 in a state of being separated from an outer peripheral surface 22 of the honeycomb adsorbent 20. The support portion 12 extends from one end of the accommodating portion 11 so as to be inclined toward an axis x of the housing 10 and supports the honeycomb adsorbent 20 at an edge 23 between one end face 21 of the honeycomb adsorbent 20 in the axis x direction and an outer peripheral surface 22. Hereinafter, a configuration of the fuel adsorption apparatus 1 will be described more specifically.

The housing 10 is made of resin and formed into a cylindrical shape. The housing 10 of the fuel adsorption apparatus 1 is formed into a cylindrical and substantially stepped shape with a substantially constant thickness. The housing 10 includes the accommodating portion 11, the support portion 12, a connection portion 13 and an open portion 14.

The accommodating portion 11 is a cylindrical part having a circular cross section that intersects the axis x. The accommodating portion 11 accommodates the honeycomb adsorbent 20. An inner diameter of the accommodating portion 11 is larger than an outer diameter of the honeycomb adsorbent 20. In a state in which the honeycomb adsorbent 20 is accommodated in the housing 10, the honeycomb adsorbent 20 remains separate from the accommodating portion 11. Space is formed between an inner surface of the accommodating portion 11 of the housing 10 and an outer peripheral surface of the honeycomb adsorbent 20.

The support portion 12 is an annular tapered part having a truncated cone shaped cross section along the axis x. The support portion 12 is formed concentrically with respect to the accommodating part 11 around the axis x. The support portion 12 is inclined toward the axis x as it goes away from the accommodating portion 11. A minimum inner diameter of the support portion 12 is smaller than an outer diameter of the honeycomb adsorbent 20. The support portion 12 supports one end of the honeycomb adsorbent 20 in the axis x direction on a slope.

The connection portion 13 is provided on a side opposite to the accommodating portion 11 from a part having a minimum inner diameter of the support portion 12. The connection portion 13 includes two cylindrical sections having a circular cross section that intersects the axis x: a first cylindrical section 13*a* and a second cylindrical section 13*b*. The first cylindrical section 13*a* and the second cylindrical section 13*b* are formed concentrically with respect to each other around the axis x. An inner diameter of the first cylindrical section 13*a* provided on the support portion 12 side of the connection portion 13 is larger than an inner diameter of the second cylindrical section 13*b* provided on a side opposite to the support portion 12. The hose 120 is connected to an end of the second cylindrical section 13*b* on a side opposite to the first cylindrical section 13*a* (see FIG. 1).

The open portion 14 is provided on the end side of the accommodating portion 11 opposite to the support portion 12. The open portion 14 is a cylindrical portion having a circular cross section that intersects the axis x. The open portion 14 is formed concentrically with respect to the accommodating portion 11 around the axis x. The fuel adsorption apparatus 1 is open to the atmosphere at the open portion 14. An inner diameter of the open portion 14 is larger than an inner diameter of the accommodating portion 11.

An annular portion 15 is provided in a transition region between the accommodating portion 11 and the open portion 14. The annular portion 15 extends outward in the diameter direction from the end of the accommodating portion 11. The sealing member 40, which will be described later, is supported by the annular portion 15 in the axis x direction.

Figure 4:
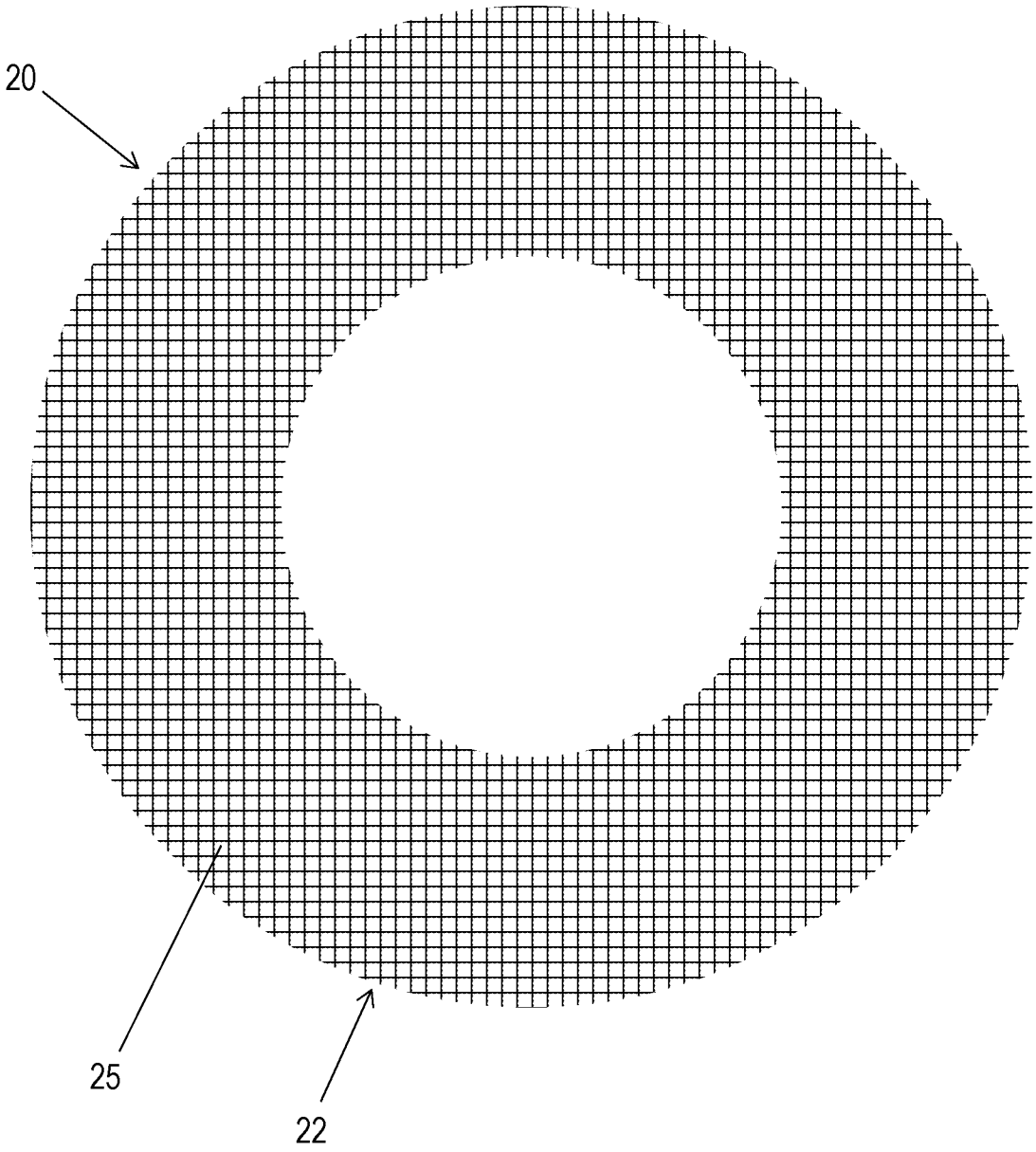
FIG. 4 is a cross-sectional view illustrating a cross section of the honeycomb structure according to the present invention.

The honeycomb adsorbent 20 is a porous material such as powdery activated carbon formed into a hollow columnar shape, and is, for example, a columnar adsorbent having a honeycomb structure having lattice-shaped thin walls 25 formed inside in a cross section intersecting the axis x (see, e.g., FIG. 4). The honeycomb adsorbent 20 adsorbs and desorbs the evaporated fuel which has reached the fuel adsorption apparatus 1 from the first fuel adsorption unit 110 via the hose 120. One end of the honeycomb adsorbent 20 along the axis x contacts the support portion 12 and another end of the honeycomb adsorbent 20 protrudes toward the open portion 14 from the accommodating portion 11.

The one end of the honeycomb adsorbent 20 along the axis x is supported by the support portion 12. The honeycomb adsorbent 20 linearly contacts the support portion 12 at the edge portion 23, which is a transition region between an end face 21 facing the support portion 12 and an outer peripheral surface 22 of the honeycomb adsorbent 20.

The filter member 30 is a disk member having a circular cross section intersecting the axis x. The filter member 30 is made of urethane or non-woven fabric cloth. The filter member 30 is provided on an end face 24 of the end of the honeycomb adsorbent 20 opposite to the end face 21 of the honeycomb adsorbent 20. A surface 31 of the filter member 30 facing a side opposite to the honeycomb adsorbent 20 is exposed to the atmosphere. The filter member 30 prevents dust from intruding into the fuel adsorption apparatus 1 from the atmosphere side. An outer diameter of the filter member 30 is the same as an outer diameter of the honeycomb adsorbent 20.

The sealing member 40 closes a gap between an outer peripheral surface 22 of the end portion of the honeycomb adsorbent 20 protruding from the accommodating portion 11 to the open portion 14 side and an inner peripheral surface of the accommodating portion 11 over all the perimeter. The sealing member 40 is made of an elastic material with high gasoline permeation resistance such as NBR or FKM. The sealing member 40 fixes the position of the honeycomb adsorbent 20 in the diameter direction in the housing 10.

The sealing member 40 is accommodated in the open portion 14 of the housing 10. The sealing member 40 includes a fixing portion 41, a contact portion 42 and a close contact portion 43. The fixing portion 41 contacts the outer peripheral surface 22 of the honeycomb adsorbent 20 and the outer peripheral surface of the filter member 30 along the axis x. The sealing member 40 includes a filter support portion 41*a* facing the end face 24 of the honeycomb adsorbent 20 on the atmosphere side of the fixing portion 41. The filter support portion 41*a* is folded at a substantially right angle toward the axis x. The filter support portion 41*a* contacts the surface 31 of the filter member 30 to restrict movement of the honeycomb adsorbent 20 and the filter member 30 along the axis x. The filter member 30 is interposed between the end face 24 of the honeycomb adsorbent 20 and the filter support portion 41*a* of the sealing member 40.

The contact portion 42 extends outward in the diameter direction from the end of the fixing portion 41 opposite to the end 41*a*. The contact portion 42 contacts the annular portion 15 between the accommodating portion 11 and the open portion 14. The close contact portion 43 extends from the end outside the contact portion 42 in the diameter direction toward the atmosphere side.

The close contact portion 43 is in close contact with the inner peripheral surface of the open portion 14 on the outer peripheral surface side opposite to the contact portion 42. The close contact portion 43 is separate from the fixing portion 41. The close contact portion 43 extends in a direction in which it goes away from the fixing portion 41 as it goes away from the contact portion 42. The close contact portion 43 is urged in a direction in which it goes away from the fixing portion 41. In the state in which the sealing member 40 is accommodated in the open portion 14, the close contact portion 43 is pushed toward the fixing portion 41 by the inner peripheral surface of the open portion 14. The close contact portion 43 closely contacts with the inner peripheral surface of the open portion 14 while it is urged to return to the original state.

In the evaporated fuel processing apparatus 100, for example, when the engine is stopped, the evaporated fuel generated from the fuel tank is introduced into the first fuel adsorption unit 110 via the charge port 112. The evaporated fuel is an air-fuel mixture of mainly hydrocarbon compound (HC) gas and air, and the HC is adsorbed to the plurality of activated carbon layers in the first fuel adsorption unit 110 and the honeycomb adsorbent 20 of the fuel adsorption apparatus 1. Air purified by passing through the plurality of activated carbon layers in the first fuel adsorption unit 110 and the honeycomb adsorbent 20 of the fuel adsorption apparatus 1 is released to the atmosphere.

On the other hand, when the engine is operating, a negative suction pressure of the engine acts on the purge port 113, the atmosphere flows into the fuel adsorption apparatus 1 from the open portion 14, passes through the honeycomb adsorbent 20 and the plurality of activated carbon layers in the first fuel adsorption unit 110 sequentially and is suctioned into the engine. The HC adsorbed in the honeycomb adsorbent 20 and the plurality of activated carbon layers in the first fuel adsorption unit 110 is purged and desorbed from the honeycomb adsorbent 20 and the activated carbon layer. The desorbed HC moves from the honeycomb adsorbent 20 to the activated carbon layers in the first fuel adsorption unit 110. The HC passes through the purge port 113, is introduced to the intake system of the engine and burned in the engine. Adsorption capacities of the plurality of activated carbon layers in the first fuel adsorption unit 110 and the honeycomb adsorbent 20 in the second fuel adsorption unit 1 are regenerated by such purging.

According to the above fuel adsorption apparatus 1, the honeycomb adsorbent 20 that can adsorb and desorb evaporated fuel is supported at one end in the axis x direction of the support portion 12 of the housing 10 without requiring any separate holding member unlike the conventional canister. It is thereby possible to omit the holding member that holds the honeycomb adsorbent 20 in the housing 10 of the fuel adsorption apparatus 1 and downsize the housing 10. Manufacturing cost can also be reduced by reducing the number of parts.

Since the accommodating portion 11 and the support portion 12 are concentric with each other, when the honeycomb adsorbent 20 is inserted in the housing 10 and one end of the honeycomb adsorbent 20 contacts the support portion 12, the honeycomb adsorbent 20 is centered in the housing 10. Accordingly, the honeycomb adsorbent 20 uniformly contacts the support portion 12 at the entire edge 23 on one end side, and so it is possible to make the surface pressure exerted on the support portion 12 uniform.

Since the elastic filter member 30 is provided in the housing 10 on the end face 24 of the honeycomb adsorbent 20 via the sealing member 40, the sealing member 40 can maintain airtightness between the honeycomb adsorbent 20 and the housing 10 of the fuel adsorption apparatus 1 at the end on the end face 24 side, and it is also possible to absorb impacts in the axial direction and diameter direction using elasticity of the sealing member 40 and the filter member 30.

Figure 3:
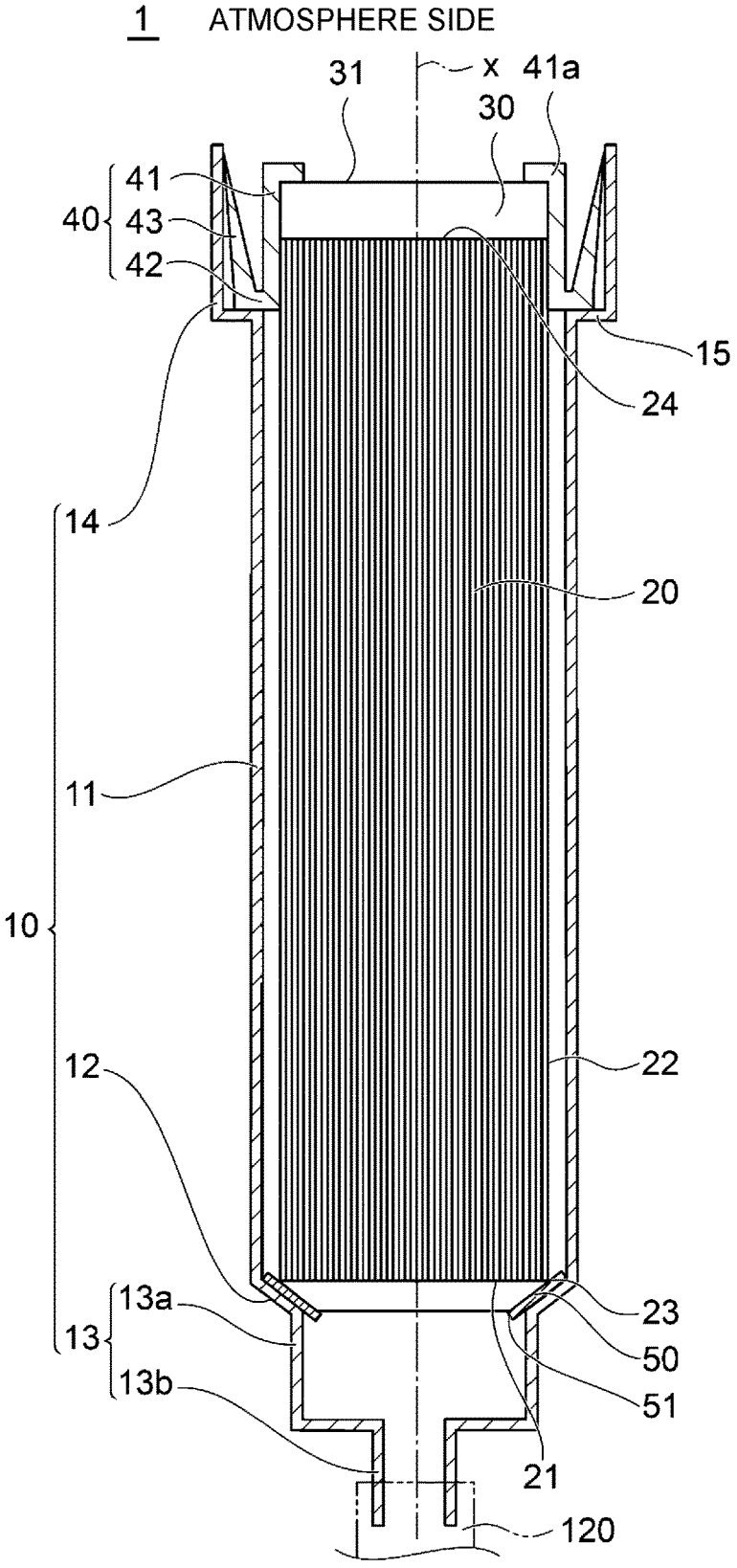
FIG. 3 is a longitudinal cross-sectional view illustrating another embodiment of the fuel adsorption apparatus according to the present invention.

Although the preferred embodiment of the present invention has been described so far, the present invention is not limited to the above embodiment, but the present invention includes all aspects included in the concept and the scope of claims of the present invention. The components may be selectively combined as appropriate so as to solve and exert at least some of the aforementioned problems and effects. Shapes, materials, arrangement, sizes or the like of the components in the above embodiments may be changed as appropriate according to specific usage forms of the present invention. For example, an elastic member 50 may be provided in the support portion 12. FIG. 3 is a view illustrating another embodiment of the fuel adsorption apparatus 1 according to the present invention and is a longitudinal cross-sectional view along the axis of the fuel adsorption apparatus 1.

The elastic member 50 is provided on a slope of the support portion 12. The elastic member 50 is an annular plate-shaped member made of an elastic material such as rubber or urethane. The cross sectional shape of the elastic member 50 along the axis x is a truncated cone shape. The elastic member 50 is interposed between the support portion 12 of the housing 10 and the edge 23 of the honeycomb adsorbent 20.

The outer peripheral surface of the elastic member 50 is in surface contact with the slope of the support portion 12. A reduced diameter part 51 of the elastic member 50 protrudes from the slope of the support portion 12. Even if the diameter of the honeycomb adsorbent 20 is smaller than a minimum inner diameter of the support portion 12, the reduced diameter part 51 can support the honeycomb adsorbent 20.

Since the honeycomb adsorbent 20 is supported by the support portion 12 via the elastic member 50, it is possible to buffer impacts transmitted from the outside to the honeycomb adsorbent 20 via the housing 10.

Note that in the above embodiment, although the first fuel adsorption unit 110 and the second fuel adsorption unit (fuel adsorption apparatus 1) are connected via the hose 120, and the housing 111 of the first fuel adsorption unit 110 and the housing 10 of the second fuel adsorption unit (fuel adsorption apparatus) 1 are separate bodies, both housings 111 and 10 may be formed as one unit.

REFERENCE SIGNS LIST

1 fuel adsorption apparatus (second fuel adsorption unit)
10 housing
11 accommodating portion
12 support portion
20 honeycomb adsorbent
30 filter member
40 sealing member
50 elastic member
100 evaporated fuel processing apparatus
110 first fuel adsorption unit
x axis

The invention claimed is:

1. A fuel adsorption apparatus, comprising:

a pillar adsorbent configured to adsorb and desorb evaporated fuel, the pillar adsorbent having an axial end face, an outer peripheral surface, and an edge disposed between the axial end face and the outer peripheral surface;

a tubular housing accommodating the pillar adsorbent;

wherein the housing includes:

a tubular accommodating portion accommodating the pillar adsorbent and disposed spaced apart from the outer peripheral surface of the pillar adsorbent; and a support portion extending obliquely from an end of the accommodating portion such that the support portion is inclined toward an axis of the housing; and wherein the edge of the pillar adsorbent rests on the support portion such that the support portion supports the pillar adsorbent at the edge.

2. The fuel adsorption apparatus according to claim 1, further comprising an elastic member disposed between the support portion of the housing and the edge of the pillar adsorbent.

3. The fuel adsorption apparatus according to claim 1, wherein:

the accommodating portion has a cylindrical shape;

the support portion has a truncated cone shape; and the support portion is arranged concentrically with respect to the accommodating portion.

4. The fuel adsorption apparatus according to claim 1, further comprising a sealing member closing a gap between the outer peripheral surface of the pillar adsorbent and an inner peripheral surface of the accommodating portion of the housing at another end of the accommodating portion, wherein the sealing member includes:

a filter support portion facing another axial end face of the pillar adsorbent; and a filter member disposed between the another axial end face of the pillar adsorbent and the filter support portion of the sealing member.

5. An evaporated fuel processing apparatus, comprising:

a first fuel adsorption unit structured and arranged to adsorb and desorb evaporated fuel from a fuel tank of a vehicle;

a second fuel adsorption unit connected to the first fuel adsorption unit and configured to adsorb and desorb the evaporated fuel from the first fuel adsorption unit;

wherein the second fuel adsorption unit includes a fuel adsorption apparatus, the fuel adsorption apparatus including:

a pillar adsorbent configured to adsorb and desorb evaporated fuel, the pillar adsorbent having an axial end face, an outer peripheral surface, and an edge disposed between the axial end face and the outer peripheral surface;

a tubular housing accommodating the pillar adsorbent, the housing including a tubular accommodating portion and a support portion;

the tubular accommodating portion accommodating the pillar adsorbent and disposed spaced apart from the outer peripheral surface of the pillar adsorbent;

the support portion extending obliquely from an end of the accommodating portion such that the support portion is inclined toward an axis of the housing; and wherein the edge of the pillar adsorbent rests on the support portion such that the support portion supports the pillar adsorbent at the edge.

6. The evaporated fuel processing apparatus according to claim 5, wherein the fuel adsorption apparatus further includes an elastic member disposed between the support portion of the housing and the edge of the pillar adsorbent.

7. The evaporated fuel processing apparatus according to claim 5, wherein the fuel adsorption apparatus further includes a sealing member closing a gap between the outer peripheral surface of the pillar adsorbent and an inner peripheral surface of the accommodating portion of the housing at another end of the accommodating portion, the sealing member including:

a filter support portion facing another axial end face of the pillar adsorbent; and a filter member disposed between the another axial end face of the pillar adsorbent and the filter support portion of the sealing member.

8. A fuel adsorption apparatus, comprising:

a tubular housing including a tubular accommodating portion and a support portion;

a honeycomb adsorbent configured to adsorb and desorb evaporated fuel, the honeycomb absorbent having a columnar shape with a first axial end face, a second axial end face, an outer peripheral surface extending between the first axial end face and the second axial end face, and an edge at which the outer peripheral surface and the first axial end face contact one another;

the support portion protruding obliquely from an end of the tubular accommodating portion such that the support portion tapers toward a longitudinal axis of the tubular housing;

the honeycomb adsorbent arranged within the tubular accommodating portion such that (i) the outer peripheral surface of the honeycomb adsorbent is disposed spaced apart from the tubular accommodating portion and (ii) the edge of the honeycomb adsorbent abuts against the support portion;

wherein the tubular housing further includes a tubular open portion protruding from a second end of the tubular accommodating portion; and wherein an internal diameter of the tubular open portion is larger than an internal diameter of the tubular accommodating portion.

9. The fuel adsorption apparatus according to claim 8, wherein the honeycomb adsorbent has a hollow columnar shape and is composed of a porous activated carbon.

10. The fuel adsorption apparatus according to claim 9, wherein the honeycomb adsorbent includes a honeycomb structure having a plurality of lattice-shaped walls.

11. The fuel adsorption apparatus according to claim 8, wherein the tubular housing further includes a connection portion disposed at an end of the support portion opposite the tubular accommodating portion.

12. The fuel adsorption apparatus according to claim 11, wherein:

the connection portion includes a first tubular portion having a first internal diameter and a second tubular portion having a second internal diameter;

the first tubular portion is disposed concentrically with respect to the second tubular portion and connects the second tubular portion to the support portion; and the first internal diameter is greater than the second internal diameter.

13. The fuel adsorption apparatus according to claim 8, wherein the honeycomb adsorbent protrudes axially from the tubular accommodating portion such that the second axial end face of the honeycomb adsorbent is disposed in the tubular open portion.

14. The fuel adsorption apparatus according to claim 13, further comprising a disk shaped filter disposed on the second axial end face of the honeycomb adsorbent, wherein an exposed end of the filter disposed opposite the honeycomb structure is exposed to an external atmosphere.

15. The fuel adsorption apparatus according to claim 14, further comprising a sealing member disposed within the tubular open portion, the sealing member extending circumferentially around the honeycomb adsorbent and axially closing a gap defined radially between the honeycomb adsorbent and the tubular accommodating portion, wherein the sealing member includes:

an axially extending main portion disposed adjacent to the outer peripheral surface of the honeycomb adsorbent;

a filter support portion projecting radially inwardly from a first end of the main portion and axially contacting the exposed end of the filter; and a contact portion connected to a second end of the main portion, the contact portion extending obliquely relative to the main portion and biased radially outwardly against the tubular open portion such that honeycomb adsorbent and filter are secured axially within the tubular housing via the sealing member.

16. The fuel adsorption apparatus according to claim 11, further comprising an elastic member disposed between and in direct contact with the support portion of the housing and the edge of the pillar adsorbent, wherein at least a portion of the elastic member projects into and is disposed within the connection portion.

17. The fuel adsorption apparatus according to claim 1, wherein the edge of the pillar adsorbent directly contacts the support portion of the housing.

18. The fuel adsorption apparatus according to claim 1, further comprising an elastic member disposed between and in direct contact with the support portion of the housing and the edge of the pillar adsorbent.

19. The fuel adsorption apparatus according to claim 1, wherein:

the tubular housing further includes a tubular open portion protruding from a second end of the tubular accommodating portion; and an internal diameter of the tubular open portion is larger than an internal diameter of the tubular accommodating portion.

20. The fuel adsorption apparatus according to claim 19, further comprising a filter member, wherein:

the pillar adsorbent protrudes axially from the tubular accommodating portion such that another axial end face of the pillar adsorbent is disposed in the tubular open portion; and the filter member is disposed within the tubular open portion and arranged on the another axial end face of the pillar adsorbent.

* * * * *